US005419673A

United States Patent [19]

Merhar

[11] Patent Number: 5,419,673

[45] Date of Patent: May 30, 1995

[54] QUICK DISCONNECT APPARATUS FOR TRACTOR FRONT LOADER

[75] Inventor: Drago Merhar, Dolenja Vas, Slovenia

[73] Assignee: Memo Industrial Planning, Inc., Southlake, Tex.

[21] Appl. No.: 29,467

[22] Filed: Mar. 11, 1993

[51] Int. Cl.[6] ..... E02F 5/14

[52] U.S. Cl. ..... 414/723; 37/468

[58] Field of Search ..... 414/723; 37/468; 292/40, 7, 36, DIG. 49

[56] References Cited

U.S. PATENT DOCUMENTS

| | | | |
|---|---|---|---|
| 2,793,892 | 5/1957 | Hutterer | 292/36 |
| 4,030,624 | 6/1977 | Matthews | 414/723 |

FOREIGN PATENT DOCUMENTS

| | | | |
|---|---|---|---|
| 814808 | 6/1969 | Canada | 414/723 |
| 55-65639 | 5/1980 | Japan | 414/723 |

*Primary Examiner*—Donald W. Underwood

*Attorney, Agent, or Firm*—Dennis T. Griggs

[57] ABSTRACT

A quick disconnect apparatus for attaching tools to a tractor front loader is disclosed which aligns quickly and is easily engageable and disengageable by a single operator.

5 Claims, 4 Drawing Sheets

QUICK DISCONNECT APPARATUS FOR TRACTOR FRONT LOADER

FIELD OF INVENTION

This invention relates generally to tractor front loader equipment, and more particularly to quick disconnect apparatus which is operable by a single operator for attaching front loader tools such as buckets, spikes, bag lifters, grabs, pallet forks and the like.

BACKGROUND OF THE INVENTION

Dedicated tractors are known which incorporate a fixed tool for performing a particular function. For example, a snow plow tractor incorporates a plow which is attached to a loader assembly and is movable for plowing and lifting snow into a pile. Other examples include farm tractors for lifting hay or spreading manure. An obvious disadvantage to these dedicated tractors is the duplication of the motorized cab.

DESCRIPTION OF THE PRIOR ART

General purpose tractors include an extendable loader assembly for accommodating removable tools so that only one motorized cab is necessary for performing a variety of functions. Removable tools for some tractors require at least two persons for installation. Such tractors are first positioned so that the loader assembly is near the tool. The operator of the tractor in conjunction with a second person then manually aligns the tool to the tractor loader assembly. Next, coupling pins or bolts are inserted through the tool and the loader assembly. This alignment procedure usually requires the coupling pins or bolts to be forced into place and requires tools such as a hammer or wrench to be carried with the tractor.

Another limitation of conventional coupling apparatus is that the coupling pins or bolts may be dropped or lost. The tractor operator must carry additional pins or bolts as replacements.

It will be appreciated that an improved coupling apparatus for tractor front loaders is needed which may be connected and disconnected by a single person, is safe to operate, and requires no external tools to engage.

SUMMARY OF THE INVENTION

The coupling apparatus of the present invention provides quick and simple change of front loader tools on a tractor. The present invention increases tractor utility and efficiency by providing safe, single operator connection and disconnection of tractor front loader tools.

One advantage of the present invention is that no external tools are required for a single operator to safely engage and disengage tractor front loader tools. Another advantage of the invention is that no detachable parts are necessary to secure the tools to the tractor. Yet another advantage is that the coupling apparatus incorporates a self leveling feature making alignment of the tool with the quick disconnect apparatus easy.

These and various other advantages and features of novelty which characterize the invention are pointed out with particularity in the claims annexed hereto and forming a part hereof. However, for a better understanding of the invention, its advantages, and the objects obtained by its use, reference should be made to the drawings and to the accompanying specification.

BRIEF DESCRIPTION OF THE DRAWINGS

Referring now to the drawings in which like reference numerals and letters indicate corresponding elements throughout the several views.

DETAILED DESCRIPTION OF THE PREFERRED EMBODIMENT

In the following description of the preferred embodiment, reference is made to the accompanying drawings which form a part hereof, and in which is shown by way of illustration a specific embodiment in which the invention may be practiced. It is to be understood that other embodiments may be utilized and structural changes may be made without departing from the scope of the present invention.

Figure 1:
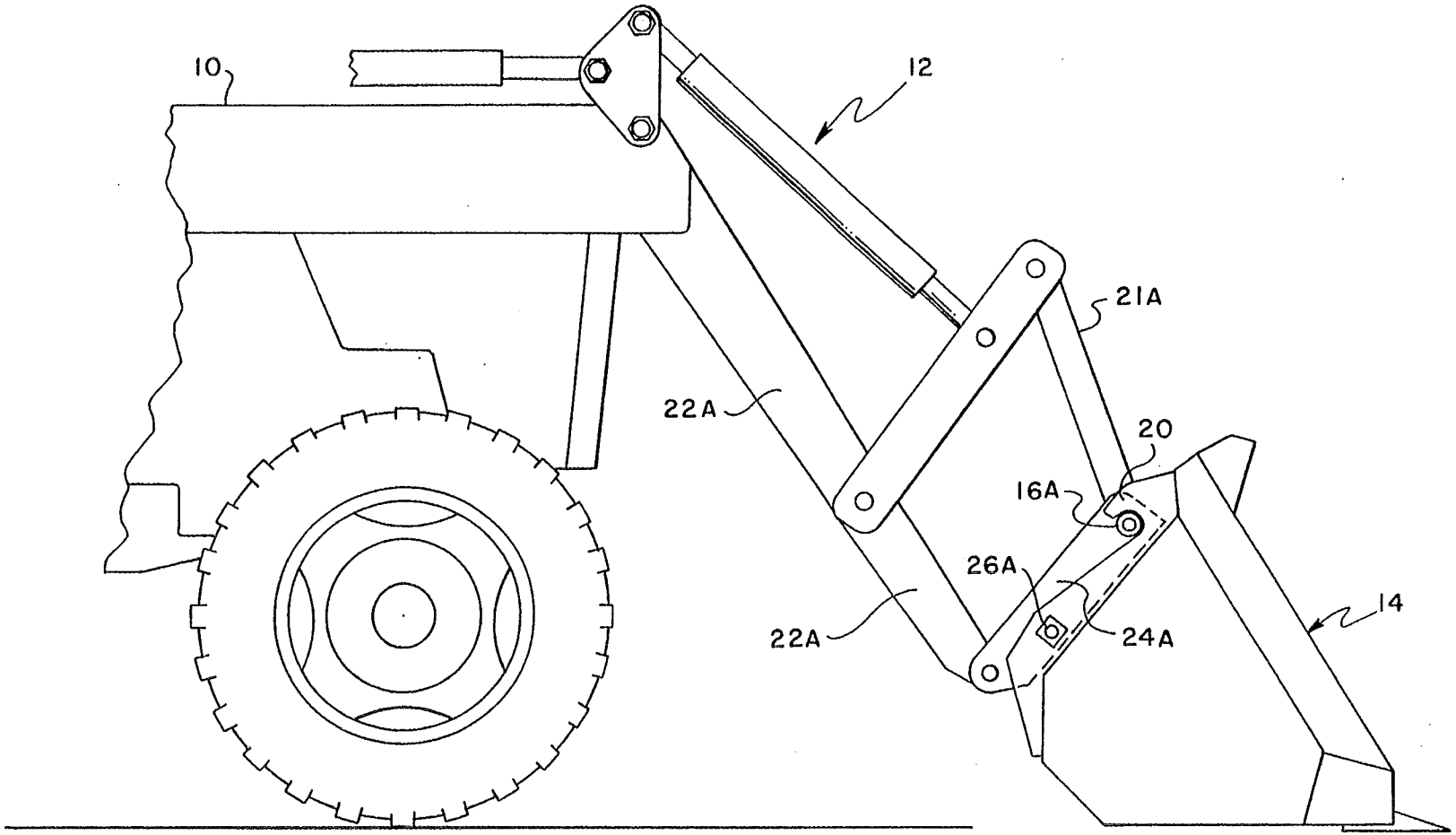
FIG. 1 depicts a partial side view of a tractor with its front loader incorporating the present invention which is further detailed in FIGS. 2, 3 and 4.

Reference is now made to FIG. 1 which depicts a partial side view of a tractor with its front loader incorporating a quick disconnect apparatus in accordance with the principles of the present invention. A tractor 10 having a hydraulically activated front loader 12 has attached to it a bucket tool 14 with the aid of the present invention. The front loader 12 includes at least two anchors 16A and 16B symmetrically disposed on either of its ends and at least two alignment sleeves 26A and 26B also symmetrically disposed on either of its ends, further detailed in FIGS. 2, 3 and 4. Symmetry of elements in the present invention is denoted throughout the drawings and disclosure by the notation A and B.

It will be apparent to those skilled in the art upon a reading of the present specification that the present invention is applicable to a front loader 12 activated by means other than hydraulics. It should also be understood that the present invention is applicable to other machines which benefit from a quick disconnect apparatus for releasing detachable tools.

Figure 2:
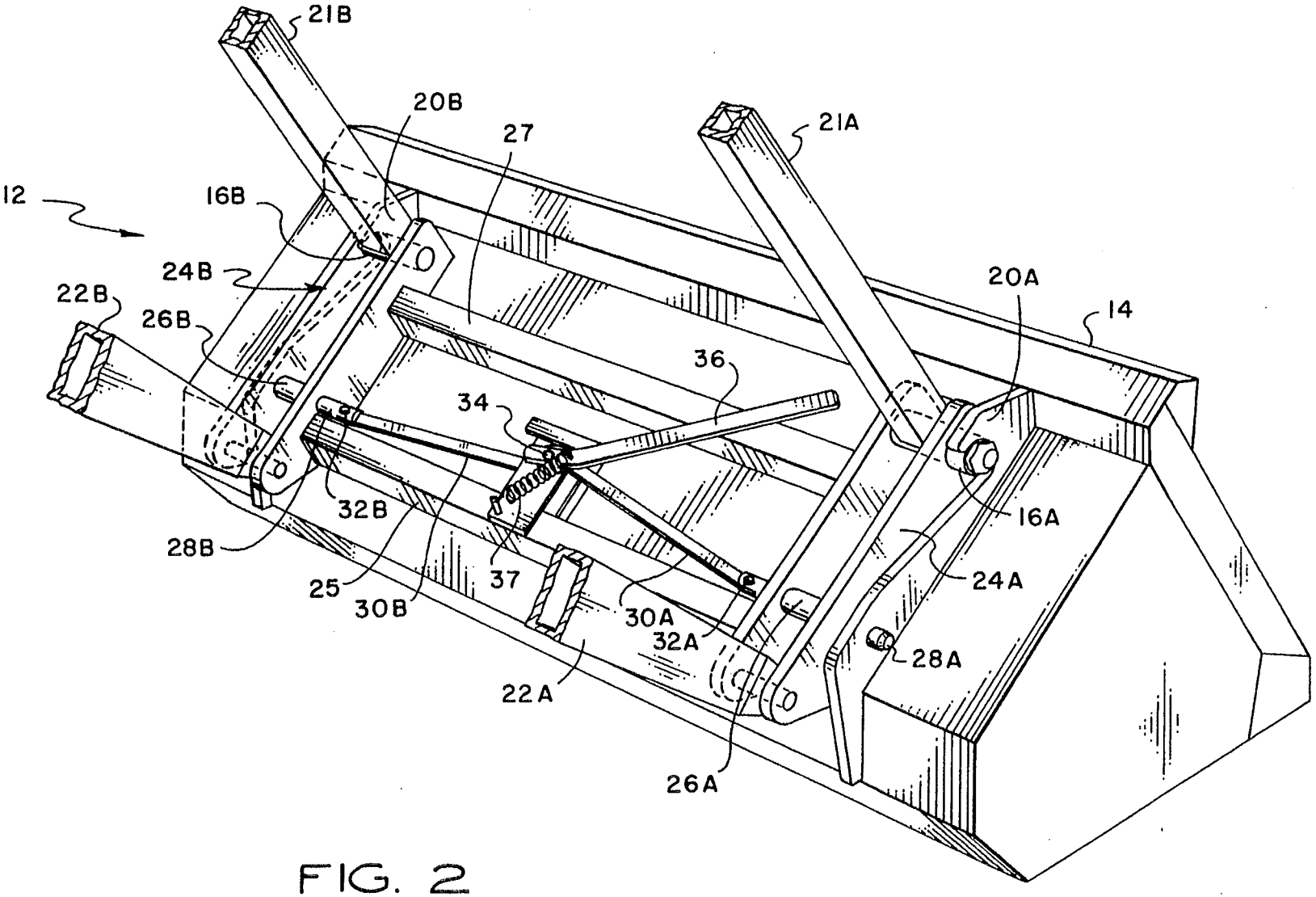
FIG. 2 depicts a partial perspective view of the front loader with the present invention engaged between the loader and a bucket.

Reference is now made to FIG. 2 which depicts a partial perspective view of the front loader 12 engaged with a bucket 14. The bucket 14 as well as other detachable tools such as, but not limited to, a manure fork, a hay spike, a pallet fork, and a grab, include at least two hook members 20A and 20B which are operatively engageable with the two anchors 16A and 16B forming a part of front loader 12. Anchors 16A and 16B extend substantially coaxial to the arc of hook members 20A and 20B. In the preferred embodiment, the portion of the front loader 12 which attaches to the bucket 14 comprises first and second member pairs (21A, 22A) and (21B, 22B) coupled together by orthogonal beams 24A and 24B and transverse members 25 and 27 thereby defining a rectangular coupling frame. Beams 24A and 24B include anchors 16A and 16B coupled to members 21A and 21B and sleeves 26A and 26B respectively. Sleeves 26A and 26B are disposed below and substantially parallel to anchors 16A and 16B. Securing pins 28A and 28B travel through sleeves 26A and 26B into securing receptacles 38A and 38B defined in sidewalls of adjacent bucket 14 for securing to front loader 12. Securing pins 28A and 28B travel coaxially with sleeves 26A and 26B and are pivotally coupled to linear translator arms 30A and 30B with hinge pins 32A and 32B respectively. A second end of arms 30A and 30B are pivotally coupled to engagement arm 36 through plate member 46 with coupling pins 40A and 40B respectively, best seen in FIG. 4 and described in more detail hereinbelow.

A coil spring 37 has its first end movably attached to engagement arm 36 and its second end rigidly attached to the front loader 12 provides biasing in the engaged or disengaged position. That is, spring 37 urges securing pins 28A and 28B through sleeves 26A and 26B into securing receptacles in bucket 14 when engagement arm 26 is rotated clockwise as viewed in FIG. 2. Likewise, spring 37 urges retraction of securing pins 28A and 28B out of the securing receptacles 38A and 38B into sleeves 26A and 26B when engagement arm 36 is rotated counterclockwise as viewed in FIG. 2. The front loader 12 may be engaged with bucket 14 so that anchors 16A and 16B couple with hook members 20A and 20B and lifted so that bucket 14 pivots about hook members 20A and 20B on anchors 16A and 16B. The operator may then easily rock bucket 14 on hook members 20A and 20B about anchors 16A and 16B to align securing receptacles 38A and 38B in bucket 14 with sleeves 26A and 26B. Securing pins 28A and 28B are then easily fitted therethrough.

Figure 3A:
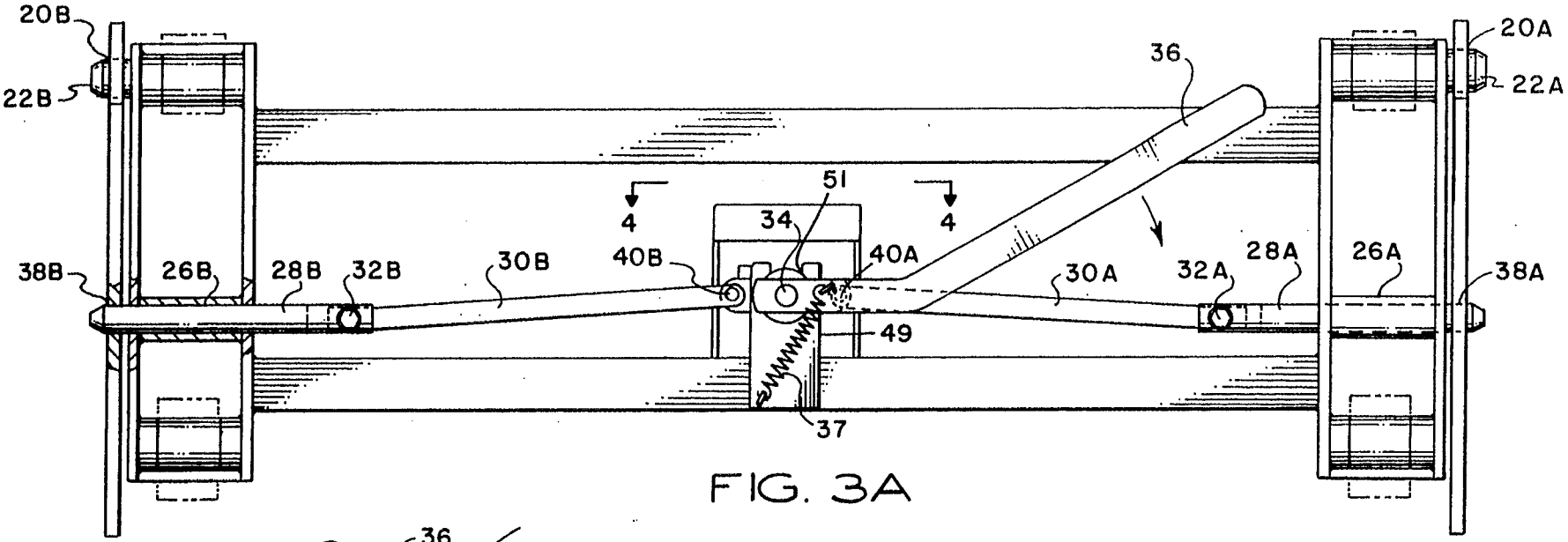
FIG. 3A and 3B depict detailed first and second cutaway views of the present invention in an engaged and a disengaged position respectively.
Figure 3B:
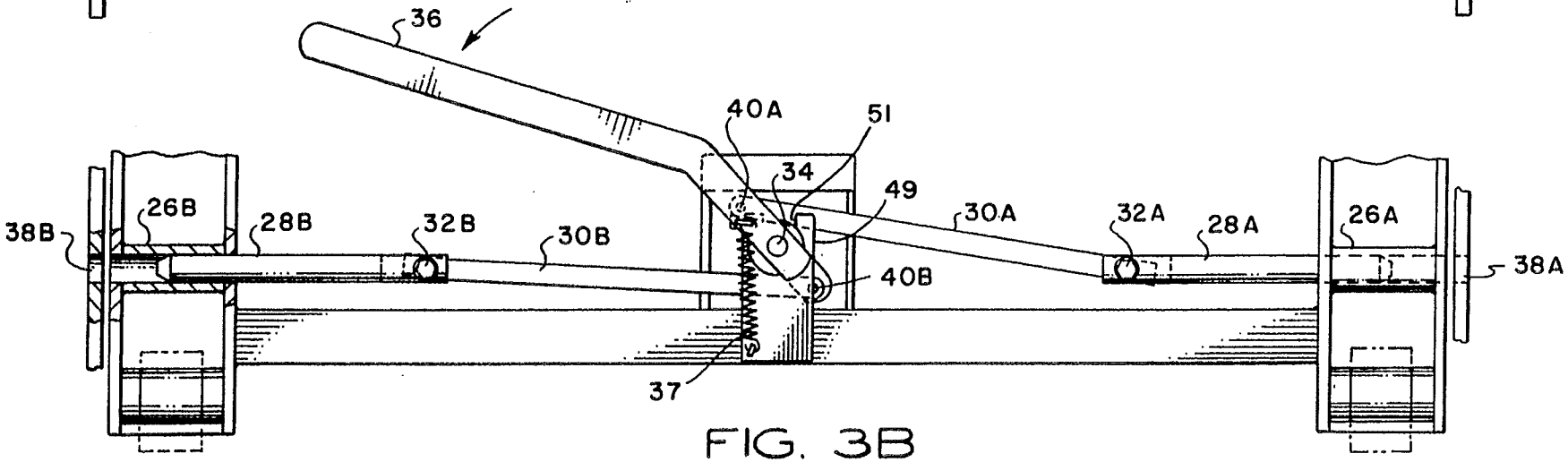

Reference is now made to FIGS. 3A and 3B which depict partial cutaway views of the present invention in an engaged and a disengaged position. As can be seen from FIG. 3A, pins **28*a* and 28*b* extend through sleeves 26*a* and 26*b* respectively, on front loader 12 and through securing receptacles 38*a* and 38*b* on bucket 14 thus operatively engaging bucket 14 to the front loader 12. As engagement arm 36 is rotated counterclockwise as seen in FIG. 3B, securing pins 28*a* and 28*b* retract from securing receptacles 38*a* and 38*b* in bucket 14 into sleeves 26*a* and 26*b* of the front loader 12 thus disengaging bucket 14 from front loader 12. Arms 30*a* and 30*b* are pivotally attached on a first end by hinge pins 32*a* and 32*b* to securing pins 28*a* and 28*b*. Pins 40*a* and 40*b* pivotally attach a second end of arms 30*a* and 30*b* to plate member 46 for engagement with engagement arm 36. Spring 37 imparts a force normal to the top surface of engagement arm 36 thus urging a torque in the clockwise or counterclockwise direction on arm 26**.

FIG. 3A depicts securing pins **28*a* and 28*b* urged in the engaged position. As engagement arm 36 is rotated counterclockwise as best seen in FIG. 3B, the normal force imparted on by spring 37 lessens until engagement arm 36 reaches a twelve o'clock position with respect to the rotational axis of pin 34. As the arm travels further in a counterclockwise direction, the normal force exerted by spring 37 on engagement arm 36 reverses surfaces. The engagement bar 36 thus urges pins 28*a* and 28*b* to retract completely from securing receptacles 38*a* and 38*b* in bucket 14 and into sleeves 26*a* and 26*b* in front loader 12**.

Figure 4:
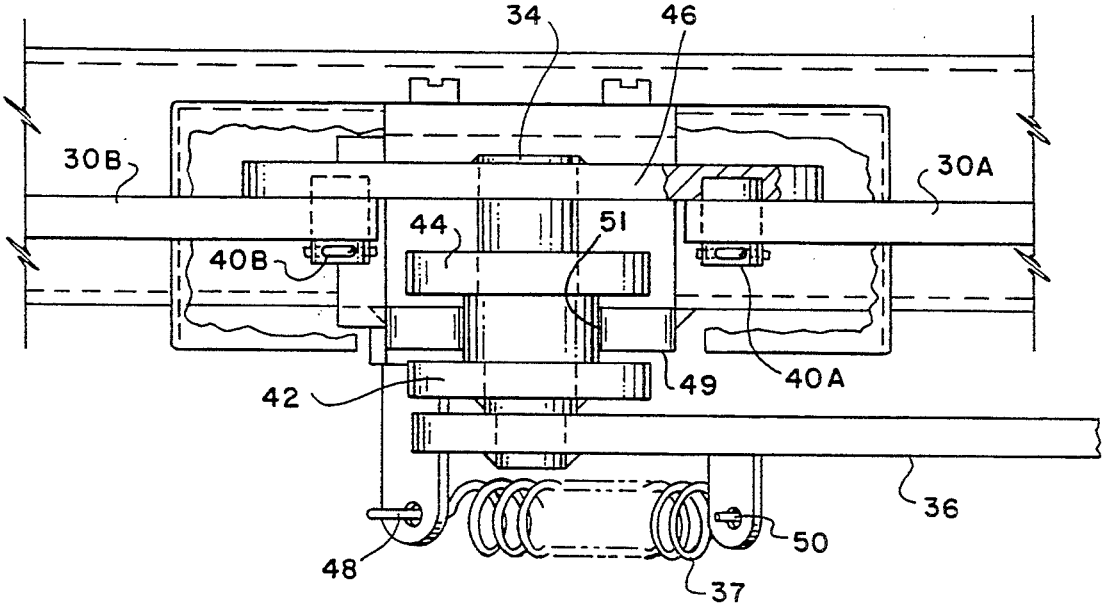
FIG. 4 depicts a detailed view of a rotary to linear translator mechanism employed with the principles of the present invention.

Reference is now made to FIG. 4 which depicts a more detailed view of a rotary to linear translator practiced in accordance with the principles of the present invention. The translator is activated by rotating engagement arm 36 in a clockwise or counterclockwise direction. Plate member 46 is rotatably attached to arm 36 through pin 34. Pins 40A and 40B couple linear translator arms 30A and 30B to plate member 46. Pins 40A and 40B are fixed to plate member 46 off the rotational axis of pin 34. Engagement arm 36 being rigidly attached to pin 34, imparts a torque on pin 34 and the attached plate member 46. As engagement arm 36 is rotated about the axis of pin 34, plate member 46 imparts a tangential force on coupling pins 40A and 40B causing arms 30A and 30B to linearly translate. The linkage between arms 30A and 30B and plate member 46 is such that rotational movement is translated into linear movement in a direction substantially coaxially with pins 28A and 28B. Bushings 42 and 44 provide a bearing surface for pin 34 and engagement arm 36 to rotate thereon. Spring 37 is rigidly attached at point 48 which is stationary with respect to the rotation of pin 34 and may be a part of the front loader 12.

The pivot pin 34 is supported for rotational movement relative to the coupling frame of the front loader by a support plate 49. The support plate 49 is attached to the front loader coupling frame, and has an open pocket 51 in which the pivot pin 34 is received. The bushings 42, 44 are mounted on the pivot pin 34 intermediate the plate member 46 and the engagement arm 36, with the bushing 42 and bushing 44 straddling the support plate 49.

As best seen from FIGS. 3A and 3B, clockwise rotation of engagement arm 36 linearly extends pins 28A and 28B through sleeve 26A and 26B into securing receptacles 38A and 38B respectively. Likewise, counterclockwise rotation of engagement arm 36 linearly retracts pins **28*a* and 28*b* from securing receptacles 38A and 38B into sleeves 26A and 26B respectively. It is to be understood that other rotational to linear translator mechanisms may be used without departing from the scope of the present invention. It is to be also understood that a linear to linear translator may also be used without departing from the scope of the present invention. Those skilled in the art will recognize other expedients for translation mechanisms which may be practiced with the securing pins 28A and 28B** without departing from the scope of the present invention.

While the preferred embodiment example has been discussed herein, the present invention is not so limited, and various aspects may be applied to other applications wherein a quick disconnect securing pin mechanism would be beneficial. The foregoing description of the preferred embodiment of the invention has been presented for the purposes of illustration and description. It is not intended to be exhaustible or to limit the invention to the precise form disclosed. Many modifications and variations are possible in light of the above teaching. It is intended that the scope of the invention be limited not by this detailed description, but rather by the claims appended hereto.

What is claimed is:

1. Apparatus for quickly attaching or detaching a tool to a coupling frame of a tractor front loader, the apparatus comprising:

a first pin and a second pin for securing the tool to the coupling frame of the tractor front loader, operatively engageable through a first sleeve and a second sleeve disposed on the coupling frame of the tractor front loader, the pins being respectively engageable into a first receptacle and a second receptacle defined in the detachable tool, the tool receptacles being alignable substantially adjacent and coaxial to the first and the second sleeves in an attaching position;

a first translator arm and a second translator arm each having a first end and a second end, the first ends of the first and second arms being pivotably attached to the first and the second securing pins respectively;

engagement and disengagement means attachable to the coupling frame of the front loader between the first and second sleeves and operatively coupled to the second ends of the first and the second translator arms, respectively, for engaging the first and-the second securing pins into the first and the second receptacles in a first position and for retracting the first and the second securing pins into the first and the second sleeves, respectively, in a second position;

a support plate securable to the front loader coupling frame, the support plate having an open pocket;

a pivot pin disposed within the open pocket for rotational movement relative to the coupling frame of the front loader;

a plate member secured to the pivot pin and coupled to the first and second translator arms;

an engagement arm secured to the pivot pin; and, first and second bushings mounted fixedly to the open pocket and receiving the pivot pin, said bushings being disposed intermediate the plate member and the engagement arm, the first and second bushings straddling the support plate on opposite sides of the open pocket.

2. An apparatus as recited in claim 1, including a spring connectable between the engagement arm and at least one beam coupling member of the loader frame.

3. Apparatus for quickly connecting and disconnecting a tool to a coupling frame of a tractor front loader comprising:

a tool having at least two hook members for operative engagement with at least two anchors disposed on the coupling frame of a tractor front loader, the tool including at least two securing receptacles for receiving at least two securing pins;

a coupling frame including the at least two anchors for attaching the tool and having at least two sleeves in which the at least two securing pins are received, the coupling frame further including first and second translator arms coupled to the first and second securing pins for inserting the pins into the at least two receptacles, respectively, in a first position, and for retracting the securing pins out of the receptacles in a second position, respectively;

a support plate secured to the coupling frame, the support plate having an open pocket;

a pivot pin disposed within the open pocket for rotational movement relative to the coupling frame of the front loader;

a plate member secured to the pivot pin and coupled to the first and second translator arms;

an engagement arm secured to the pivot pin; and, first and second bushings mounted fixedly to the bearing pocket and receiving the pivot pin intermediate the plate member and the engagement arm, the first and second bushings straddling the support plate on opposite sides of the open pocket.

4. Apparatus as recited in claim 3 wherein the engagement means further comprises:

the first and second translator arms each having a first end pivotably coupled to respective first and second securing pins and having a second end pivotally coupled to the plate member, wherein rotational movement of the plate member by the engagement arm in a first direction drives the first and the second securing pins into the at least two receptacles, and rotational movement of the plate member in an opposite direction retracts the securing pins from the receptacles.

5. Apparatus as recited in claim 4 wherein the frame includes beam coupling members and a spring connected between the engagement arm and at least one of the beam coupling members.

* * * * *